US005902154A

United States Patent [19]

Nakata

[11] Patent Number: 5,902,154

[45] Date of Patent: May 11, 1999

[54] ELECTRICAL CONNECTOR

[75] Inventor: Naohisa Nakata, Tokyo, Japan

[73] Assignee: Hirose Electric Co., Ltd., Tokyo, Japan

[21] Appl. No.: 08/816,265

[22] Filed: Mar. 13, 1997

[30] Foreign Application Priority Data

Mar. 21, 1996 [JP] Japan ..... 8-89901

[51] Int. Cl.[6] ..... H01R 21/22

[52] U.S. Cl. ..... 439/660

[58] Field of Search ..... 439/284, 292–295, 439/660

[56] References Cited

U.S. PATENT DOCUMENTS

| | | | |
|---|---|---|---|
| 3,101,231 | 8/1963 | Klostermann | 439/660 |
| 5,181,855 | 1/1993 | Mosquera et al. | 439/291 |
| 5,266,038 | 11/1993 | Nakamura | 439/83 |
| 5,295,843 | 3/1994 | Davis et al. | 439/637 |
| 5,593,311 | 1/1997 | Lybrand | 439/295 |

FOREIGN PATENT DOCUMENTS

| | | | |
|---|---|---|---|
| 3-53755 | 8/1991 | Japan . | |
| 6-88076 | 12/1994 | Japan . | |
| 295583 | 5/1965 | Netherlands | 439/295 |

OTHER PUBLICATIONS

IBM Technical Disclosure Bulletin, vol. 29, No. 8, p. 3631, Jan. 1987.

*Primary Examiner*—Neil Abrams
*Attorney, Agent, or Firm*—Kanesaka & Takeuchi

[57] ABSTRACT

The electrical connector includes a housing (1) having a cavity (2); female terminals (7) having a support section (7A) supported by the housing and a flexible section (7C) extending from the support section and having a contact portion (7C1); protective walls (3) extending in the cavity and having separation sections (3B) and a connection section (3C) for connecting the separation sections on the front side to form accommodation spaces (3A) for housing the flexible sections (7C) such that the contact portion projected from the accommodation spaces.

1 Claim, 5 Drawing Sheets

ELECTRICAL CONNECTOR

BACKGROUND OF THE INVENTION

1. Field of the Invention

The present invention relates to electrical connectors having female terminals.

2. Description of the Related Art

FIG. 6 shows a conventional electrical connector having a plurality of terminals arranged in rows. The electrical connector 50 includes a housing 52 and a plurality of male pin terminals 51 arranged in three rows in a cavity 53 of the housing 52. A mating connector (not shown) is fitted into the cavity 53 and has a plurality of female terminals for connection with the male terminals 51. The female terminals have flexible sections with contact portions for resilient contact with the male terminals 51.

As the number of terminals in a row increases, the width of the connector increases, and there is a increasing danger that terminals are damaged when the mating connector is plugged into the cavity 53 of the connector 50. Especially, the female terminals are less rigid than the male terminals and susceptible to deformation, resulting in poor or no contact of the contact sections.

To prevent such damage, columns 54 and protruded walls 55 are provided within the cavity 53 of the housing 52 for guiding the mating connector to prevent damage to and/or deformation of the terminals, especially the female terminals.

Japanese patent application Kokoku No. 53755/91 and Japanese UM patent Kokai No. 88076/94 disclose such connectors. The former discloses columns provided within the cavity of the housing while the latter discloses protruded walls.

In the above connectors, however, it is impossible to dispose terminals in the areas where the columns and/or protruded walls exist, making the connector larger and failing to meet a recent demand for miniaturization.

SUMMARY OF THE INVENTION

Accordingly, it is an object of the invention to provide an electrical connector having female terminals which are protected from damage upon plugging in and out without the use of such columns and protruded walls.

According to the invention there is provided an electrical connector which includes a housing having a cavity; female terminals having a support section supported by the housing and a flexible section extending from the support section and having a contact portion. Protective walls extend in the cavity and have separation sections and connection sections for connecting the separation sections on their front side. The separation and connection sections define accommodation spaces for housing the flexible sections of the female terminals such that the contact portions project from the accommodation spaces. The separation sections are connected to top or bottom sections for forming accommodation spaces in which the female terminals are placed. Alternatively, the accommodation spaces are opened on top and bottom sides.

With such an electrical connector it is possible to arrange the female terminals with a predetermined pitch without losing any of them. The front ends of the female terminals are protected by the connection sections from abutting against the mating connector upon forced plugging. Also, adjacent female terminals are separated by the separation sections disposed between them.

The separation sections are made thin because their front ends are connected to the connection sections and reinforced so that it is possible to dispose them between the female terminals without disturbing the predetermined pitch. Thus, the compact connector having the predetermined number of female terminals is provided.

DESCRIPTION OF THE PREFERRED EMBODIMENTS

Embodiments of the invention will now be described with reference to the accompanying drawings.

Figure 1:
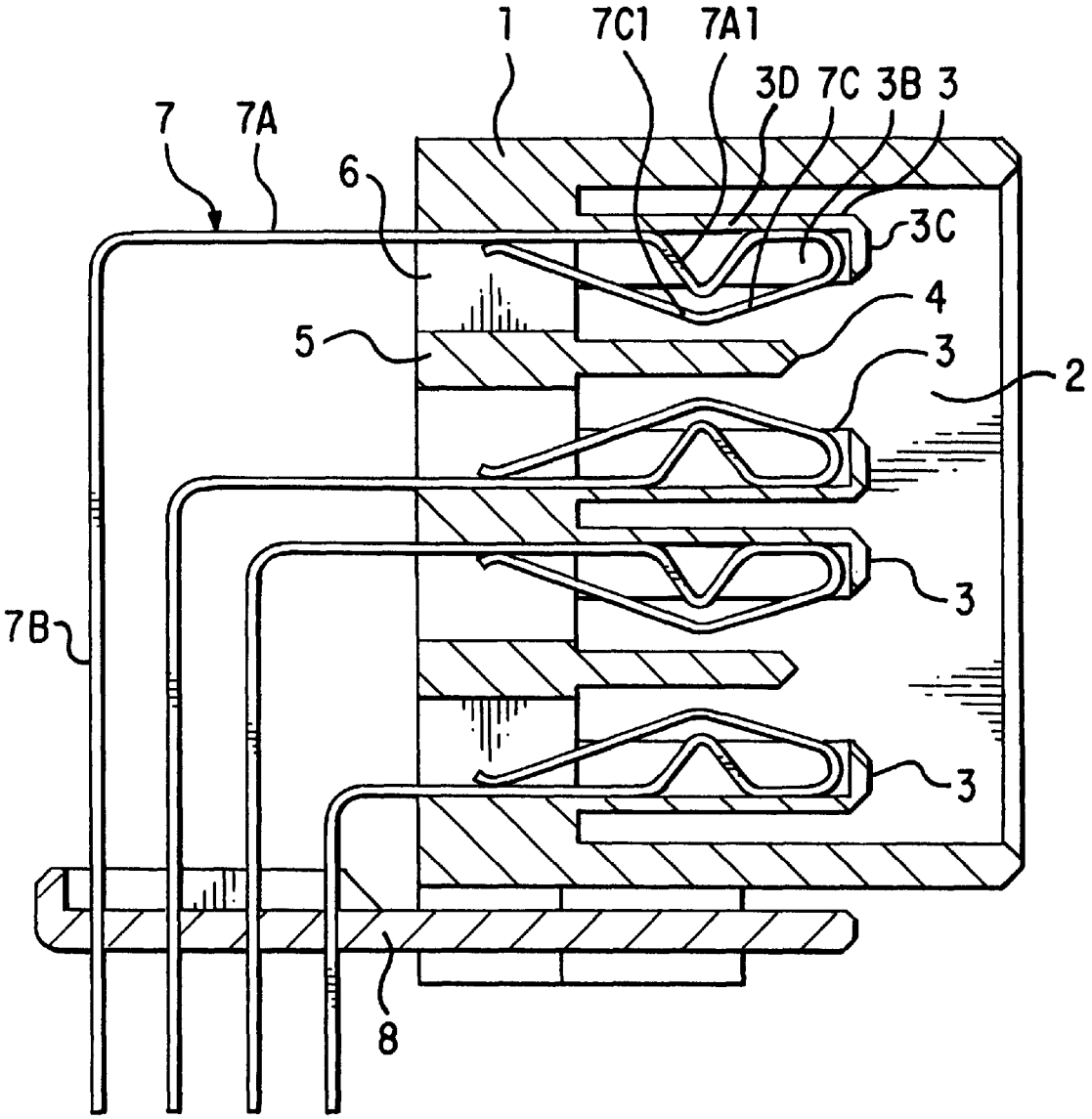
FIG. 1 is a sectional view of a connector according to an embodiment of the invention.

In FIG. 1, a housing 1 has a substantially rectangular form elongated in a direction perpendicular to the sheet and a cavity 2 open to the right in the figure. Upper and lower pairs of protective walls 3 extend into the cavity 2 of the housing 1. A guide wall 4 is provided between each pair of the protective walls 3. The guide walls 4 and the protective walls 3 are molded integrally with the housing 1.

Figure 2:
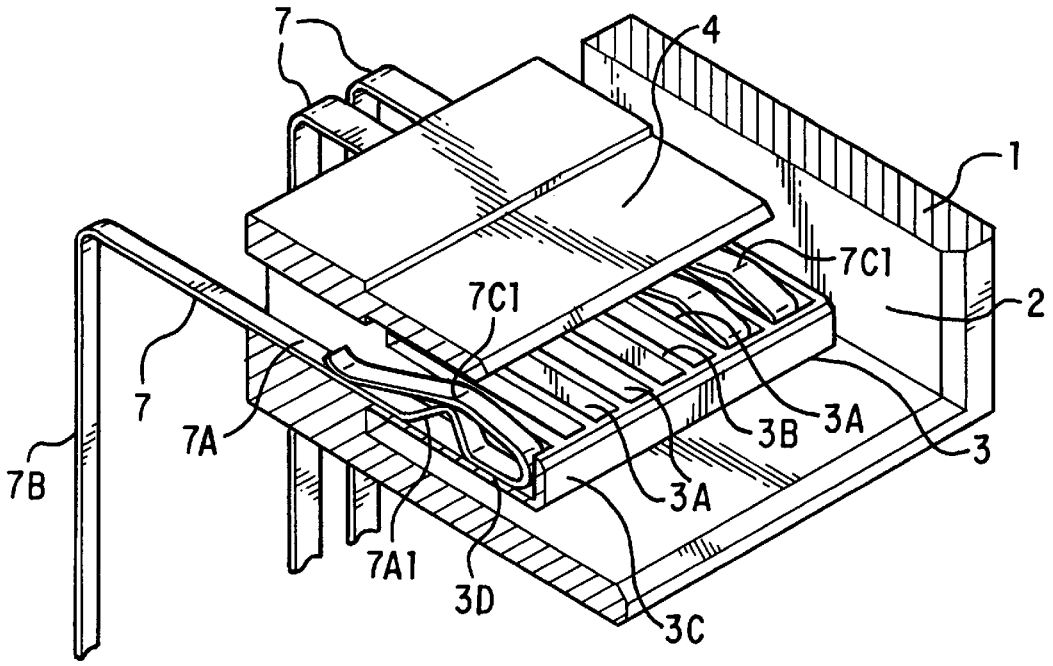
FIG. 2 is a partially cut-out perspective view of a protective wall and a guide wall of the connector.

In FIG. 2, which shows the bottom protective wall 3 and the guide wall 4 thereabove, a plurality of accommodation spaces 3A are provided on the protective wall 3. The accommodation spaces 3A communicate terminal apertures 6 provided on a rear wall 5 of the housing (FIG. 1). A plurality of L-shaped female terminals 7 are inserted through the terminal apertures 6 such that their front contact sections are housed in the accommodation spaces 3A. The female terminals 7 are made by bending and forming a metal sheet so as to form a support section 7A supported by the housing 1, a connection section 7B extending downwardly at right angles from the support section, and a flexible section 7A folded back to the support section 7A. A V-shaped regulation section 7A1 is provided in the support section 7A. The flexible section 7C has a peak at a position corresponding to the regulation section 7A1 to form a contact portion 7C1. A predetermined gap is provided between the contact portion 7C1 and the regulation section 7A1. As best shown in FIG. 2, two female terminals to the right are made wider than the other terminals to serve as power terminals while the other are signal terminals.

Each accommodation space 3A of the protective wall 3 is defined by separation walls 3B, a connection wall 3C, and a bottom or top wall 3D. The separation walls 3B are made thin and connected to the connection wall 3C and the thin bottom or top wall 3D with a predetermined pitch. The flexible section 7C and the regulation section 7A1 of each female terminal 7 is housed in the accommodation space 3A defined by the separation walls 3B, the connection wall 3C, and the bottom or top wall 3D such that the contact portion 7C1 projects from the accommodation space 3A.

The guide wall 4 provided between the upper and lower protective walls 3 has a front end tapered so as to facilitate guidance of the mating connector. The guide wall 4 is made shorter than the protective walls 3 in this embodiment, but it depends on the guide of a mating connector.

As shown in FIG. 1, a holder 8 is provided on the bottom of the housing 1 to hold the connection section 7B of the female terminal 7 in a predetermined position.

Figure 3:
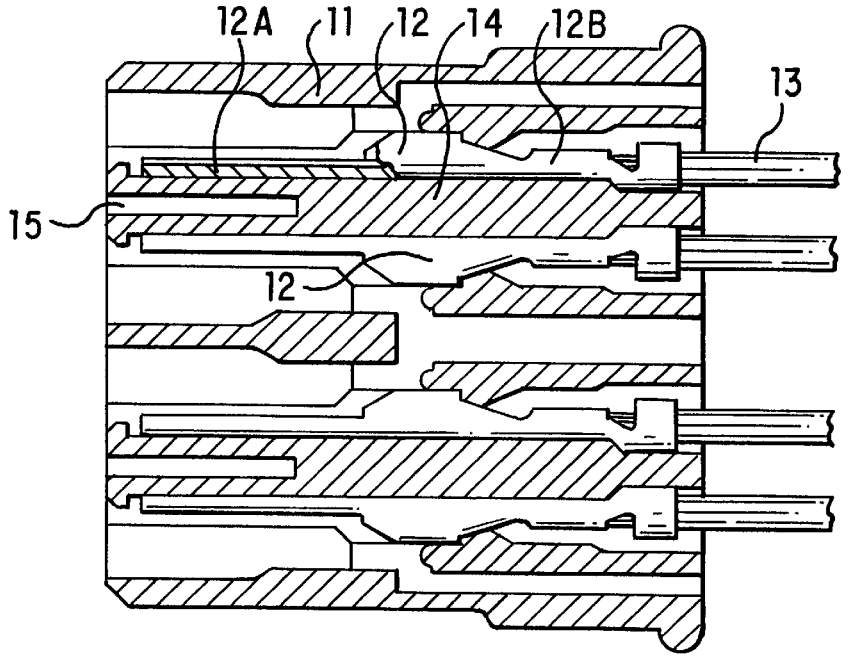
FIG. 3 is a sectional view of a mating connector to be plugged into the connector.

In FIG. 3, the mating connector includes a housing 11 and a plurality of male terminals 12 inserted therein. Each male terminal 12 has a front contact plate 12A and a rear crimping section 12B to which a wire 13 is crimped. Two or upper and lower pairs of the male terminals 12 are arranged in a direction perpendicular to the sheet so as to correspond to the female terminals 7 of FIG. 2. A slit 15 extends in a direction perpendicular to the sheet in an intermediate wall 14 between the two adjacent male terminals 12.

Figure 4:
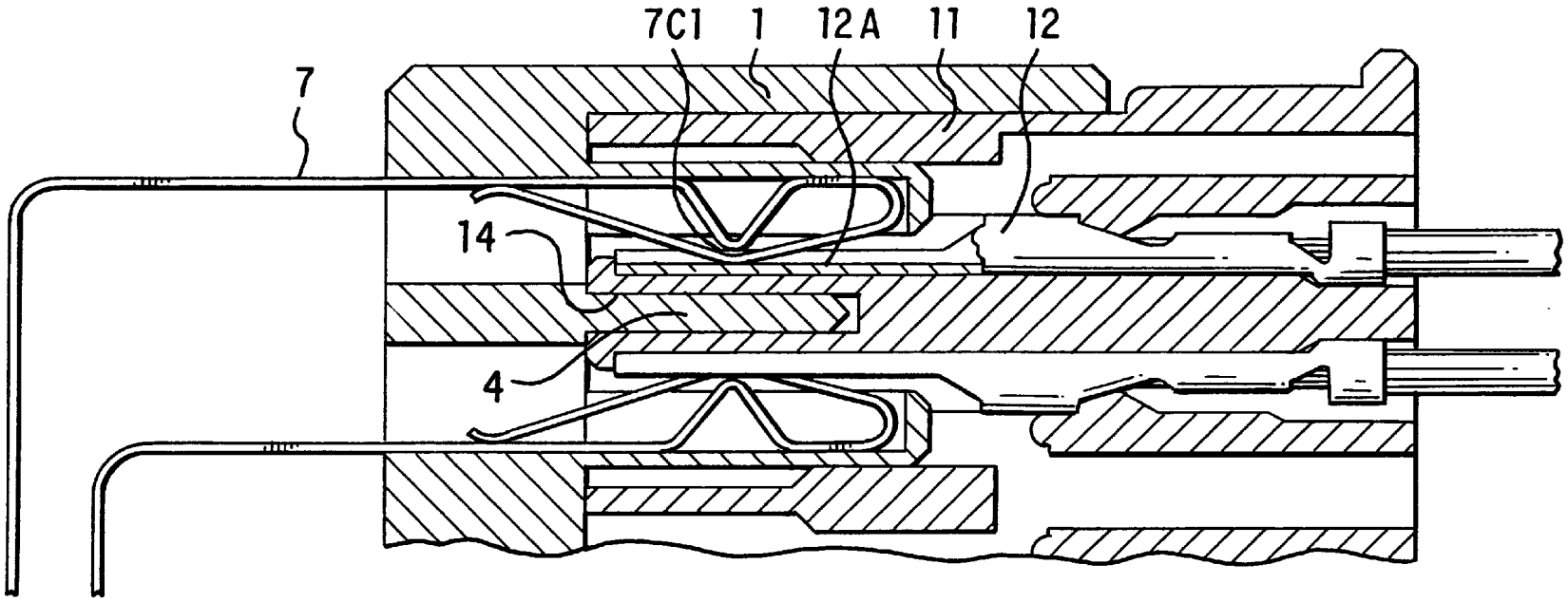
FIG. 4 is an enlarged sectional view of part of the connector into which the mating connector is plugged.

In FIG. 4, the mating connector of FIG. 3 is plugged into the connector of FIG. 1 such that the outside walls and the slits 15 of the housing 11 are guided by the cavity 2 and the guide walls 4 of the housing 1 according to the invention. The contact portions 12A of the male terminals 12 are brought into contact with the resilient contact portions 7C1 of the female terminals 7. The female terminals 7 are protected by the protective walls 3 upon plugging so that even if the mating connector is forcibly plugged, the female terminals are neither deformed nor damaged.

Figure 5:
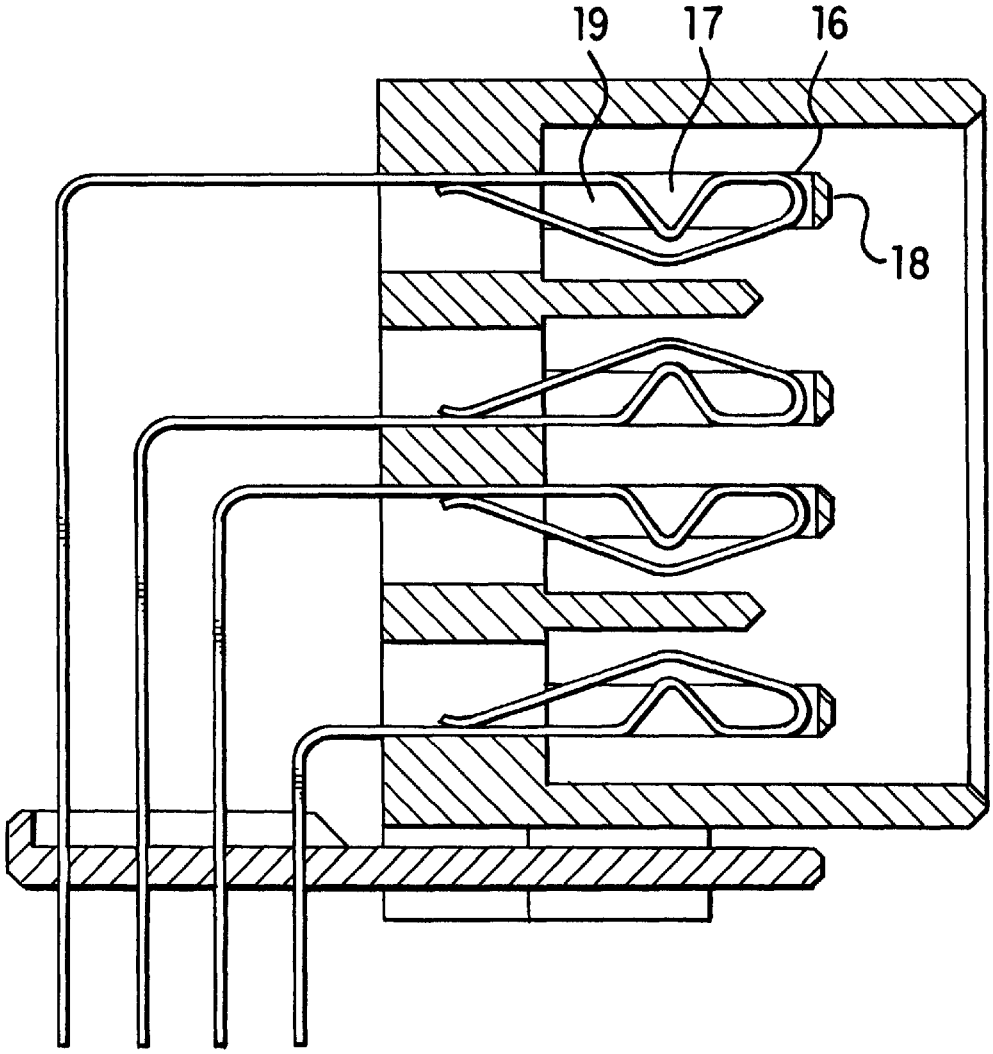
FIG. 5 is a sectional view of a connector according to another embodiment of the invention.
Figure 6:
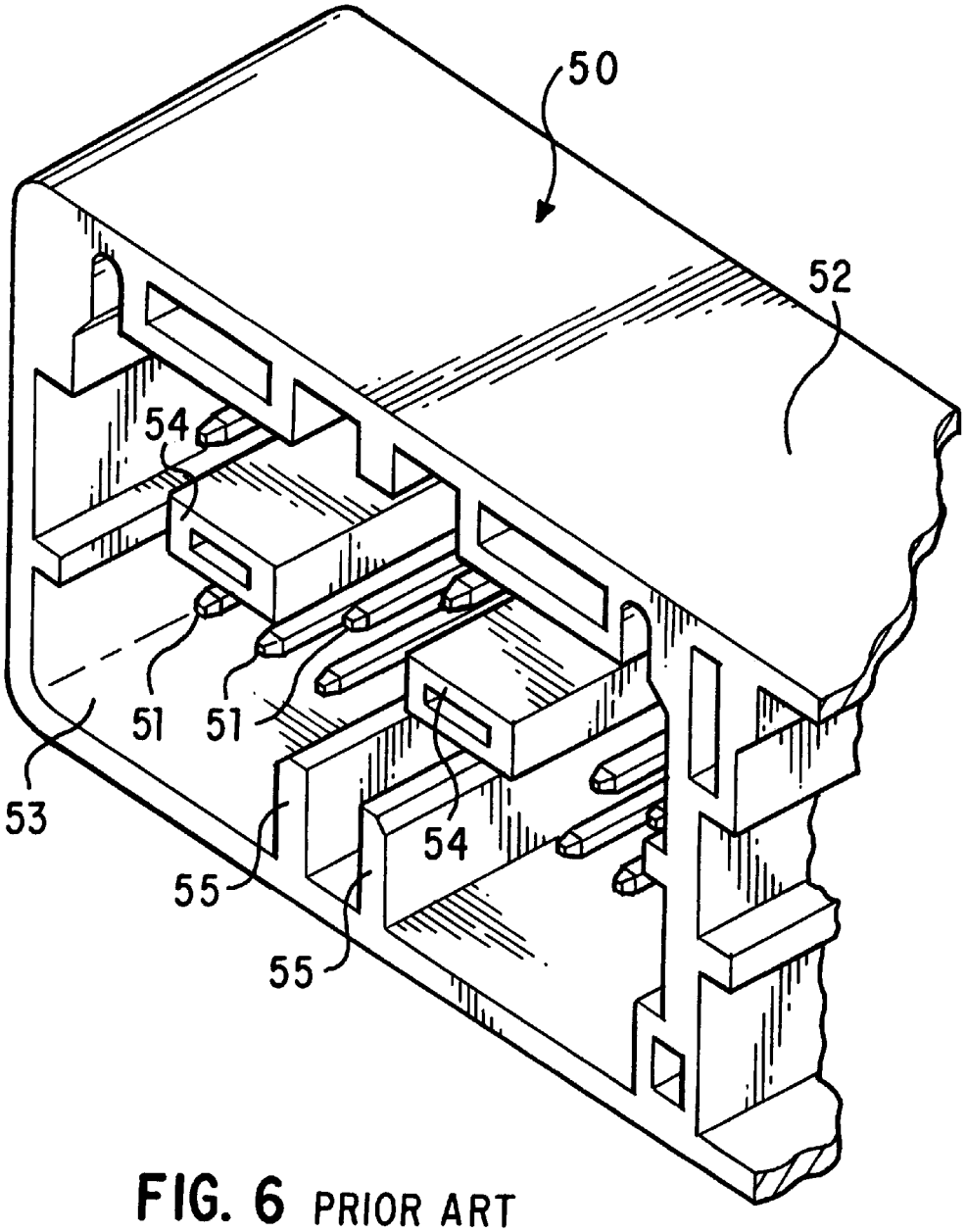
FIG. 6 PRIOR ART
FIG. 6 is a perspective view of part of a conventional connector.

Many modifications may be made to the embodiment as shown in FIGS. 1–4. In FIG. 5, for example, the protective walls 16 are composed of only separation walls 17 and connection walls 18. That is, neither bottom nor top walls 3D of FIG. 1 are provided so that the accommodation spaces 19 are defined only by the separation walls 17 and the connection walls 18, with the top and bottom opened. In this case, it is possible to reduce the height of the connector by the thickness of top and bottom walls. This connector is plugged into the mating connector of FIG. 3 in the same way as shown in FIG. 4.

According to the invention, the resilient contact portions of female terminals are housed in the accommodation spaces so that the resilient contact portions are protected from forced plugging of a mating connector especially by the connection sections. The separation walls are connected to the connection walls so that it is possible to make them sufficiently thin to be arranged between the respective female terminals which are arranged with a predetermined pitch. In addition, neither column nor protruded wall is required in the connector so that the number of female terminals is maximized or the width of the connector is made less than that of the conventional one for a predetermined number of female terminals. In the embodiment wherein neither top nor bottom wall is provided to form accommodation spaces, the height of the connector also is minimized.

What is claimed is:

1. An electrical connector comprising:

a housing having a cavity;

a plurality of terminals each having a support section supported by said housing and a flexible section folded back from said support section and having a contact portion;

a plurality of separation walls extending forwardly from a rear wall of said housing into said cavity in a plurality of planes provided one upon another; and a plurality of connection walls each provided for one of said planes for connecting said separation walls at their front ends to define a plurality of accommodation planes as openings arranged at least vertically so as to pass completely through said accommodation planes vertically for housing said flexible sections such that at least uppermost and lowermost contact portions project inwardly from said accommodation planes into a central region between said planes so that when mating connector is plugged-in, said uppermost and lowermost contact portions are flexed outwardly to apply pressure on said plugged-in mating connector, thereby assuring stable connection between said two connectors.

* * * * *